United States Patent [19]

Tell

[11] 4,425,084

[45] Jan. 10, 1984

[54] EJECTOR DEVICE

[75] Inventor: Peter Tell, Österskär, Sweden

[73] Assignee: AB Piab, Stockholm, Sweden

[21] Appl. No.: 324,473

[22] Filed: Nov. 24, 1981

[30] Foreign Application Priority Data

Dec. 11, 1980 [SE] Sweden ..... 8008733

[51] Int. Cl.[3] ..... F04F 5/00

[52] U.S. Cl. ..... 417/161; 417/191

[58] Field of Search ..... 417/161, 190, 191, 54

[56] References Cited

U.S. PATENT DOCUMENTS

| | | | |
|---|---|---|---|
| 1,344,967 | 6/1920 | Suczek | 417/54 |
| 1,421,843 | 7/1922 | Schmidt | 417/189 X |
| 3,204,862 | 9/1965 | Hadeler | 417/161 |

*Primary Examiner*—Edward K. Look

*Attorney, Agent, or Firm*—Witherspoon & Hargest

[57] ABSTRACT

An ejector device having an adjustment characteristic which is stepless variable in dependence of the negative pressure generated by the ejector device. The ejector device comprises a portion (16) for connection with a source of positive pressure which delivers the work pressure to the ejector device (1) to give rise to the ejector action. A portion (2) includes inlet (18) for the member which is intended to use the negative pressure created by ejector device (1). The two portions (16, 2) of the ejector device (1) are stepless movable in relation to each other, and in the space therebetween is an adjustment plate (13) for controlling the suction action obtained by the ejector device (1). The outlet slit (17) of the ejector device (1) is located between the plate (13) and the portion intended for connection with the positive pressure source. The adjustment plate (13) is connected to a stem (10) which is movable in relation to the portion (2) for connection with the negative pressure member. Stem 10 is fixed in relation to the portion (16) to which the positive pressure source is connected.

8 Claims, 1 Drawing Figure

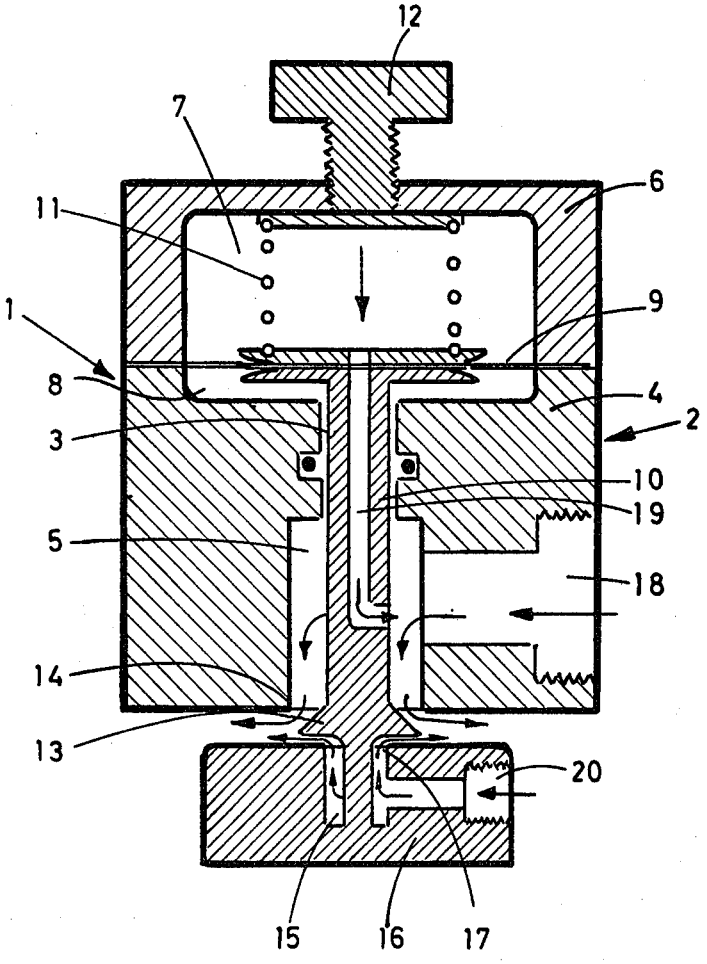
12
7
6
11
9
1
8
4
2
3
10
19
5
18
14
13
20
15
16
17

EJECTOR DEVICE

BACKGROUND OF THE INVENTION

1. Field of the Invention

The present invention relates to ejectors and more precisely to an ejector having an adjustment characteristic which is stepless variable in dependence of the negative pressure created by the ejector.

2. Description of the Prior Art

Previously known ejectors comprise at least one set of ejector nozzles located in series for evacuating compartments arranged in series. Said compartments are connected to a vacuum collection chamber through openings provided with valves. Such an ejector which is called multi-ejector is rather expensive due to the fact that it is necessary to have several nozzles which are manufactured to accurate dimensions and a valve system which gives an adjustment characteristic which acts in steps in dependence of the created negative pressure. Such a multi-ejector is also comparatively big.

SUMMARY OF THE INVENTION

The object of the present invention is to obtain an ejector which substantially has the same efficiency as a so called multi-ejector but which works by the aid of only one nozzle. Like multi-ejectors, the present ejector has a great capacity in the beginning of the operation. Such capacity automatically is decreased stepless to the same extent as the negative pressure is reduced towards the value which can be obtained by the aid of the ejector, i.e. about 0.1% of the actual atmospheric pressure.

This object is reached by an ejector of the type referred to in the claims from which the features especially characterizing the invention also are clear.

BRIEF DESCRIPTION OF THE DRAWING

The invention is more closely described in connection with the attached drawing showing a schematical cross-section through one embodiment of an ejector in accordance with the invention.

DESCRIPTION OF THE PREFERRED EMBODIMENT

In the shown embodiment the ejector 1 comprises a housing 2 made up of two portions, one portion 4 having a through bore 3 and enclosing a primary negative pressure chamber 5 and one portion 6 enclosing a secondary negative pressure chamber 7. The portions 6 and 4 are mounted to each other such as by being screwed together. The through bore 3 in the portion 4 opens into a recess 8 in one side of the portion 4. Portion 6 contains a recess constituting the secondary negative pressure chamber 7. Such recess of portion 6 had the same length and width or diameter as recess 8 and is faced thereagainst. A diaphragm 9 is inserted between portions 4 and 6.

A stem 10 extends through the bore 3 and is axially movable therein. The stem 10 extends up to the diaphragm 9 and is in a conventional way attached thereto. A spring 11 in the secondary negative pressure chamber 7 biases the diaphragm 9 and accordingly the stem 10 in a direction extending from the secondary negative pressure chamber 7. A calibration screw 12 is inserted opposite the diaphragm 9, and by the aid thereof the bias of the spring 11 can be adjusted. The chamber constituted by the recess 8 and the diaphragm 9 is preferably connected to the atmosphere.

The through bore 3 at the end of the housing portion 4 which is opposite the secondary negative pressure chamber 7 is enlarged to form the primary negative pressure chamber 5. Said enlargement opens around the stem 10 in the end surface of the housing portion 2. The chamber 5 as well as the through bore 3 are preferably of cylindrical shape. The stem 10 extends through the end wall of the housing portion 4 and is there provided with a projecting ring 13 which is conically shaped at the side facing the chamber 5 ring 13 in cooperation with the edge 14 at the opening of the chamber 5 constitutes an ejector nozzle. The stem 10 continues to an extent below the ring 13 where it is essentially narrower than the rest of the stem 3. Around this part of the stem there is a positive pressure chamber 15. Chamber 15 is of circular cross-section and is enclosed in a block 16 to which the stem 3 is attached. The positive pressure chamber 15 is open towards the under-side of the conical ring 13. Ring 13 is radially extended to form a slit 17. Said slit 17 is intended to give rise to ejector action by gas which under positive pressure is suplied to the chamber 15 and flows out through said slit. The edges of and around the ring 13 may be rounded in a suitable way in order to obtain correct flowing characteristics.

Ring 13 need not be conically shaped as shown but can be of any suitable shape from absolutely plane to a bow shape.

There is an inlet 18 to the primary negative pressure chamber 5 which is intended to be connected to the apparatus in which the created negative pressure is to be used. Through the stem 10 there is a duct 19 connecting the secondary negative pressure chamber 7 to the primary negative pressure chamber 5.

The positive pressure chamber 15 is provided with a socket 20 to which a conduit for pressurized air or other fluid is intended to be connected.

The ejector in accordance with the invention operates in the following way:

Pressurized air or some other gas or liquid under pressure is supplied at the socket 20 and therefrom flows into the chamber 15 and up and out through the slit 17. In the shown embodiment of the invention said slit is not adjustable but is adapted to the positive pressure at which the ejector is intended to work. Due to the fact that the block 16 may be screwable along the narrow end of the stem 3, the slit 17 can be adjustable.

When the pressurized air or other fluid is supplied the conical surface of the ring 13 is, due to the action of the spring 11, a maximum distance from the edge 14. In this position the ejector action is such as to cause the chamber 5 and the device connected thereto through the socket 18 to be evacuated. Due to the fact that the slit between the surfaces of 13 and 14 is big the evacuated amount is also big. As the air pressure in the chamber 5 is decreased, the pressure in the secondary negative pressure chamber 7 is decreased and the diaphragm 9 is forced upwardly in accordance with the drawing. The result thereof is that the conical surface of the ring 13 is brought closer to the edge 14 thereby altering the characteristic and further decreasing the negative pressure in the chamber 5. Said action is continued until the conical surface 13 is as close to the edge 14 as is structurally possible. The size of the slit can be determined by any adjustable means or can be predetermined.

Hence, by the present invention an ejector fulfilling the objects referred to above has been obtained.

I claim:

1. An ejector comprising, a housing having an internal cavity and an inlet and outlet extending through said housing portion to said cavity for passage of fluid to be evacuated from said housing inlet to said housing outlet, said housing portion cavity comprising a compartment divided into two chambers by a diaphragm extending across said compartment, one of said chambers being at atmospheric pressure, and the other of said chambers communicating with a portion of said housing portion cavity between said housing portion inlet and outlet;

a block portion having an internal cavity and an inlet and outlet extending through said block portion to said block portion cavity for passage of pressurized fluid from said block portion inlet to said block portion outlet to facilitate evacuation of said fluid to be evacuated, said housing portion outlet being adjacent said block portion outlet and said block portion being moveable relative to said housing portion in response to changes in fluid pressure in said housing portion cavity;

an adjustment plate coupled to said block portion at said block portion outlet for varying the size of said housing portion outlet in response to said movement, said plate being spaced from said block portion outlet to provide an opening for passage of said pressurized fluid; and, a stem one end of which is attached to said adjustment plate and the other end of which extends into said housing portion cavity and is attached to said diaphragm for causing said movement in response to said changes in fluid pressure in said housing portion cavity.

2. The ejector of claim 1 wherein said diaphragm extends from a first wall of said compartment to a second wall of said compartment.

3. The ejector of claim 2 wherein a spring is contained in said other chamber, said spring extending between one of said other chamber walls and said diaphragm to bias said stem to an equilibrium.

4. The ejector of claim 3 wherein a calibrating screw extends through said housing portion at said other chamber wall and bears against means within said other chamber for adjusting the tension in said spring.

5. The ejector of claim 1 wherein said stem includes a bore which extends through said stem from said other chamber to said portion of said housing portion cavity between said housing portion inlet and outlet.

6. The ejector of claim 1 wherein said adjustment plate is of circular cross-section and is conical in longitudinal section, the surface of said conical portion being adjacent to said housing portion outlet to form a variable housing portion outlet in response to said movement.

7. The ejector of claim 1 wherein said housing portion cavity further includes a primary negative pressure chamber of circular cross-section adjacent said housing portion inlet and outlet and communicates with said one chamber.

8. The ejector of claim 7 wherein said stem extends from said block portion to said diaphragm by extending through said primary negative pressure chamber and said one chamber, and including a sealing member extending about said stem to seal said primary negative pressure chamber from said one chamber.

* * * * *